US007556484B2

(12) United States Patent
Doi et al.

(10) Patent No.: US 7,556,484 B2
(45) Date of Patent: Jul. 7, 2009

(54) COMPRESSOR HAVING A SMALL-WIDTH PORTION AND A LARGE-WIDTH PORTION IN AN INNER CIRCUMFERENTIAL SLIDING SURFACE OF A SWINGING ROLLER

(75) Inventors: Takahiro Doi, Kusatsu (JP); Hiroyuki Taniwa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 328 days.

(21) Appl. No.: 10/586,741

(22) PCT Filed: Jan. 21, 2005

(86) PCT No.: PCT/JP2005/000770

§ 371 (c)(1),
(2), (4) Date: Jul. 21, 2006

(87) PCT Pub. No.: WO2005/071269

PCT Pub. Date: Aug. 4, 2005

(65) Prior Publication Data

US 2008/0240961 A1 Oct. 2, 2008

(30) Foreign Application Priority Data

Jan. 22, 2004 (JP) ..... 2004-014273

(51) Int. Cl.
*F03C 2/00* (2006.01)
*F03C 4/00* (2006.01)
*F04C 18/00* (2006.01)

(52) U.S. Cl. ..... 418/66; 418/179; 418/249

(58) Field of Classification Search ..... 418/64–67, 418/137, 138, 179, 249
See application file for complete search history.

(56) References Cited

U.S. PATENT DOCUMENTS

| | | | | |
|---|---|---|---|---|
| 4,904,302 | A * | 2/1990 | Shimomura | 75/233 |
| 5,641,279 | A * | 6/1997 | Yamamoto | 418/66 |
| 2006/0153723 | A1 * | 7/2006 | Kurita et al. | 418/66 |

FOREIGN PATENT DOCUMENTS

| | | | |
|---|---|---|---|
| JP | 57176686 | U * | 11/1982 |
| JP | 05-164071 | A | 6/1993 |
| JP | 2541182 | B2 | 6/1993 |
| JP | 06147165 | A * | 5/1994 |
| JP | 08165995 | A * | 6/1996 |

* cited by examiner

*Primary Examiner*—Theresa Trieu
(74) *Attorney, Agent, or Firm*—Global IP Counselors

(57) ABSTRACT

A piston 4 has a generally cylindrical-shaped roller and a blade that is integrally formed with the roller. The piston 4 performs a swing motion while orbitally revolving within a cylinder chamber of a cylinder. A light-load side portion of an inner circumferential sliding surface of the roller is provided as a small-width portion which is smaller in width than a heavy-load side large-width portion. The small-width portion is formed over a range from a point A resulting from a 30° displacement to a point B resulting from a 180° displacement in a rotational direction of the drive shaft from a base point which is given by a joining point O of the roller with the blade. The piston 4 orbitally revolves within the horizontal plane, and the small-width portion of the roller serves as an oil sump in such a manner that upper side portion of the inner circumferential sliding surface is cut out.

4 Claims, 4 Drawing Sheets

COMPRESSOR HAVING A SMALL-WIDTH PORTION AND A LARGE-WIDTH PORTION IN AN INNER CIRCUMFERENTIAL SLIDING SURFACE OF A SWINGING ROLLER

CROSS-REFERENCE TO RELATED APPLICATIONS

This U.S. National stage application claims priority under 35 U.S.C. §119 (a) to Japanese Patent Application No. 2004-014273, filed in Japan on Jan. 22, 2004, the entire contents of which are hereby incorporated herein by reference.

TECHNICAL FIELD

The present invention relates to a compressor.

BACKGROUND OF THE INVENTION

One of conventionally available compressors is a rotary compressor including a cylinder which defines a cylinder chamber, a cylindrical-shaped roller which axially rotates while orbitally revolving within the cylinder chamber, a blade which is provided independent of the roller and which is held by the cylinder so as to be advanceable toward and withdrawable from within the cylinder chamber, and a drive shaft having an eccentric portion to be fitted to an inner circumferential sliding surface of the roller. In this rotary compressor, as the drive shaft is driven into rotation, the roller rotates and revolves within the cylinder chamber, and moreover moves relative to the blade. Further, the cylinder chamber is divided by the roller and the blade into a suction chamber and a compression chamber to perform suction and compression action.

With respect to this rotary compressor, in view of reducing mechanical loss by reducing the viscous shear loss of lubricating oil at the outer circumferential sliding surface of the eccentric portion and the inner circumferential sliding surface of the roller, a measure shown below has been proposed (JP 2541182 B). This measure is that the outer circumferential sliding surface of the eccentric portion of the drive shaft has a small-width portion provided on one side opposite to the load side, i.e. on a light-load side, of the outer circumferential sliding surface, to which less load is applied when the load is maximized, the small-width portion being made smaller than a large-width portion on the heavy-load side in terms of the axial width of the outer circumferential sliding surface, so that the viscous shear loss of oil at the outer circumferential sliding surface of the eccentric portion and the inner circumferential sliding surface of the roller is reduced to thereby reduce the mechanical loss.

The small-width portion of the outer circumferential sliding surface of the eccentric portion of the drive shaft is formed primarily by mechanical machining. In this case, while centers of the drive shaft body positioned on axial both sides of the eccentric portion are kept eccentric from the center of the rotating shaft of the machine, the machining work of the small-width portion needs to be carried out by accurately positioning the center of the eccentric portion at the center of the rotating shaft of the machine, hence being an extremely laborious machining work. Accordingly, it has been the case that the machining of the small-width portion would take quite large numbers of man-hours, resulting in higher costs of the conventional compressor.

SUMMARY OF THE INVENTION

An object of the present invention is to provide a compressor which is capable of reducing mechanical loss by reducing the viscous shear loss of lubricating oil between the outer circumferential sliding surface of the eccentric portion of the drive shaft and the inner circumferential sliding surface of the roller, and moreover which is easy to machine, low in price and high in precision.

The present inventor considered that in the prior art rotary compressor described above, since the roller and the blade are provided independent of each other and since the roller rotates, the light-load side and the heavy-load side of the inner circumferential sliding surface of the roller change along with the rotation of the roller. This makes it impossible to provide a small-width portion and a large-width portion in the inner circumferential sliding surface of the roller, with the result that a small-width portion and a large-width portion are provided in the outer circumferential sliding surface of the eccentric portion in spite of a difficulty in mechanical machining. Thus, the present inventor considered that inhibiting the roller from rotating to fix the light-load side and the heavy-load side of the inner circumferential sliding surface of the roller makes it possible to provide the small-width portion and the large-width portion in the inner circumferential sliding surface of the roller.

The present invention having been achieved based on the above considerations, according to the present invention, there is provided a swing compressor comprising:

a cylinder which defines a cylinder chamber;

a piston composed of a generally cylindrical-shaped roller which orbitally revolves along an inner surface of the cylinder chamber and a blade which is formed integrally with the roller and which is swingably held by the cylinder; and a drive shaft having an eccentric portion which is slidably fitted to an inner circumferential sliding surface of the roller, wherein the piston divides a space inside of the cylinder into a suction chamber and a compression chamber and performs a swing motion by rotation of the drive shaft, and wherein the inner circumferential sliding surface of the roller includes a large-width portion which receives a heavy load; and a small-width portion which is smaller in width than the large-width portion and which receives a light load.

In the swing compressor of the above structure, the roller does orbitally revolve and does not axially rotate, and the piston formed integrally of the roller and the blade does swing motion and does not axially rotate. Accordingly, the heavy-load side and the light-load side of the inner circumferential sliding surface of the roller are fixed and does not change. Thus, according to the present invention, the small-width portion of the inner circumferential sliding surface of the roller is positioned at all times on the light-load side, which is less liable to occurrence of wear and seizure, while the large-width portion is positioned at all times on the heavy-load side. As a consequence, there is provided a swing compressor in which the viscous shear loss of lubricating oil between the outer circumferential sliding surface of the eccentric portion of the drive shaft and the inner circumferential sliding surface of the roller can be reduced on the light-load side by the small-width portion so that the mechanical loss can be reduced and moreover that the swing compressor becomes easy to machine, low in price and high in precision. Further, on the heavy-load side, wear and seizure can be prevented by the large-width portion of the inner circumferential sliding surface of the roller.

Also, since the roller is cylindrical-shaped and moreover its inner circumferential surface and the outer circumferential surface are concentric and generally cylindrical-surface shaped, the machining work of the small-width portion of the inner circumferential sliding surface of the roller can be carried out with more ease, lower price and higher precision, as compared with machining work for the small-width portion on the outer circumferential sliding surface of the eccentric portion of the drive shaft in the prior art example. Further, the main body of the drive shaft and the eccentric portion are not present on one identical plane perpendicular to the center axis of the drive shaft, whereas the roller and the blade are positioned on one generally identical plane perpendicular to the center axis of the roller. Thus, the machining work of the small-width portion of the inner circumferential sliding surface of the roller can be carried out with ease, low price and high precision.

In an embodiment, assuming that a reference line is given by an intersecting line between a plane passing through a center of the blade and parallel to the blade and the inner circumferential sliding surface of the roller, the small-width portion is formed over a range from a line obtained by a 30° displacement of the reference line to a line obtained by a 180° displacement of the reference line in a rotational direction of the drive shaft in the inner circumferential sliding surface.

In this embodiment, assuming that the reference line is given by an intersecting line between the plane passing through the center of the blade and parallel to the blade and the inner circumferential sliding surface of the roller, the small-width portion is formed over a range from the line obtained by the 30° displacement of the reference line to the line obtained by the 180° displacement of the reference line in the rotational direction of the drive shaft in the inner circumferential sliding surface. That is, the start point of the small-width portion is obtained by a 30° shift from the coupling portion between the blade and the roller serving as a start point of the light load portion. Therefore, even if a large load acts on a vicinity of the coupling portion between the blade and the roller during the discharge operation, the vicinity does not cause any damage because the vicinity is not the small-width portion but the large-width portion, so that enough durability can be ensured and the safety can be ensured.

It has been found that if the small-width portion is provided in a region of the inner circumferential sliding surface obtained by a less than 30° displacement of the reference line in the rotational direction of the drive shaft, enough strength of the coupling portion between the blade and the roller cannot be ensured. It has also been found that if the small-width portion is provided at a position obtained by a more than 180° displacement of the reference line in the rotational direction of the drive shaft in the inner circumferential sliding surface, the small-width portion would be positioned on the heavy-load side, making a cause of seizure. Accordingly, in this embodiment, the small-width portion is formed within the range from the line resulting from a 30° displacement to the line resulting from a 180° displacement of the reference line in the rotational direction of the drive shaft in the inner circumferential sliding surface of the roller. As a result of this, in this embodiment, enough strength of the coupling portion between the blade and the roller, i.e. a vicinity of foot portion of the blade, can be ensured, and moreover the viscous shear loss of lubricating oil between the outer circumferential sliding surface of the eccentric portion of the drive shaft and the small-width portion of the inner circumferential sliding surface of the roller can be reduced. Thus, the mechanical loss can be reduced and the seizure can be prevented.

In an embodiment, the small-width portion is provided on one side with respect to a plane passing through a center of the blade and parallel to the blade, the one side including a suction port which is provided in the cylinder and which communicates with the suction chamber.

In this embodiment, the small-width portion is provided on the suction port side of the cylinder with respect to the plane passing through the center of the blade and parallel to the blade. Accordingly, the small-width portion is positioned on the light-load side unique to the inner circumferential sliding surface of the roller of the swing compressor and never so done on the heavy-load side. Thus, the seizure of the inner circumferential sliding surface of the roller can be prevented.

In an embodiment, the piston is placed so as to orbitally revolve along a horizontal plane, and an upper edge of the small-width portion is located lower than an upper edge of the large-width portion.

In this embodiment, since the upper edge of the small-width portion is located lower than the upper edge of the large-width portion, the region extending from the upper edge of the small-width portion to the upper edge of the large-width portion serves as an oil sump for the lubricating oil, so that occurrence of lubrication insufficiency at the outer circumferential sliding surface of the eccentric portion and the inner circumferential sliding surface of the roller can be prevented and occurrence of wear and seizure can be prevented. For instance, a portion upper than the upper edge of the small-width portion of the inner circumferential sliding surface of the roller is formed in such a manner that a cutout portion is provided in an axial upper side portion of the horizontally positioned roller. This cutout portion serves as an oil sump during the operation of the compressor, so that occurrence of lubrication insufficiency at the sliding surfaces of the outer circumferential sliding surface of the eccentric portion and the inner circumferential surface of the roller can be prevented and occurrence of wear and seizure can be prevented.

In an embodiment, the drive shaft is so placed as to be inclined with respect to a horizontal plane, and an upper edge of the small-width portion is located lower than an upper edge of the large-width portion with respect to a direction of the drive shaft.

In this embodiment, since the upper edge of the small-width portion is located lower than the upper edge of the large-width portion with respect to the direction of the drive shaft, the region extending from the upper edge of the small-width portion to the upper edge of the large-width portion serves as an oil sump for the lubricating oil, so that occurrence of wear and seizure at the outer circumferential sliding surface of the eccentric portion and the inner circumferential sliding surface of the roller can be prevented.

In an embodiment, the drive shaft is placed along a vertical direction.

In this embodiment, the region between the upper edge of the small-width portion and the upper edge of the large-width portion can be fully utilized as an oil sump. Thus, with the formation of an oil sump of large capacity, occurrence of wear and seizure at the outer circumferential sliding surface of the eccentric portion and the inner circumferential sliding surface of the roller can reliably be prevented.

In an embodiment, the piston is formed of a sintered material.

In this embodiment, since the piston is made of a porous sintered material, lubricating oil is held in cavities formed on the surface and inside of the piston, allowing enough lubrication to be ensured. Moreover, since the molding of the piston with the sintered material allows after machining to be omitted, the manufacturing cost for the piston can be cut down. In particular, when the small-width portion is formed with the provision of the cutout portion, the cutout portion can be molded simultaneously in molding process of the piston, so that the product precision can be improved and the manufacturing cost can be cut down.

According to the present invention, there can be provided a compressor in which the viscous shear loss of lubricating oil between the outer circumferential sliding surface of the eccentric portion of the drive shaft and the inner circumferential sliding surface of the roller can be reduced, thus allowing mechanical loss to be reduced, and which is easy to machine, low in price and high in precision.

DETAILED DESCRIPTION OF THE INVENTION

Figure 1:
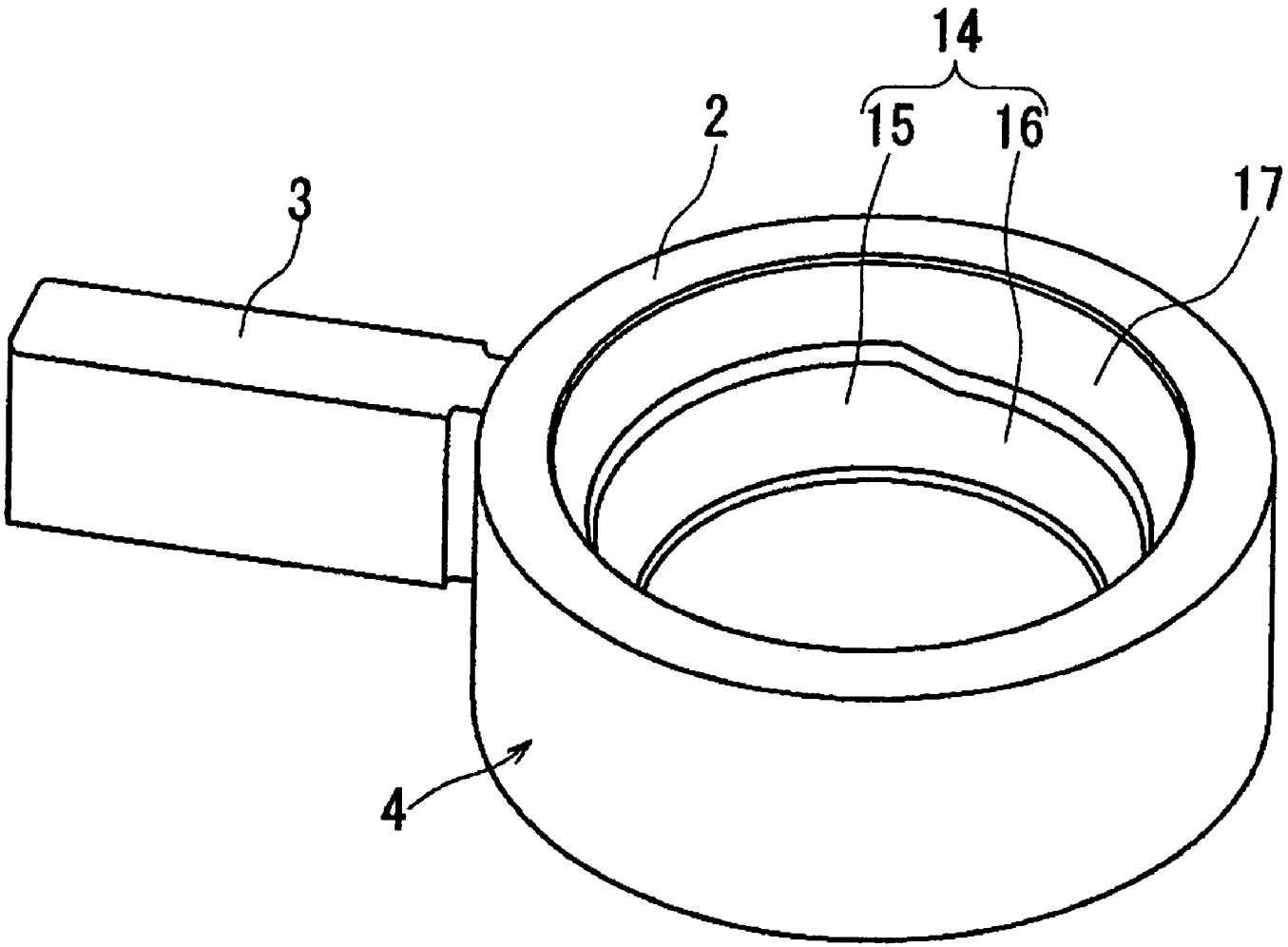
FIG. 1 is a perspective view showing a roller of a swing compressor according to one embodiment of the present invention.

Hereinbelow, concrete embodiments of the swing compressor according to the present invention are described in detail with reference to the accompanying drawings.

FIGS. 3A, 3B, 3C and 3D are schematic plan views showing main part of the swing compressor. This swing compressor is intended for use, for example, as a compressor for refrigerators using HFC (hydrofluorocarbon) base refrigerants. The swing compressor has a piston 4 integrally made up of a generally cylindrical-shaped roller 2 and a blade 3 that protrudes radially outward of the roller 2. An outer circumferential cylindrical surface and an inner circumferential cylindrical surface of the roller 2 are concentric with each other. The inner circumferential cylindrical surface, i.e. inner circumferential sliding surface, of the roller 2 of the piston 4 is slidably fitted to the outer circumferential sliding surface of an eccentric portion 5 formed integrally with a drive shaft 1. The piston 4 is accommodated in a cylinder chamber 8 formed in a cylinder 6 and having a generally circular-shaped cross section. The cylinder 6 has a bushing fitting hole 7 formed in adjacency to the cylinder chamber 8, to which bushing fitting hole 7 generally semicircular pillar-shaped bushings 9, 9 are fitted. These bushings 9, 9 are so positioned that flat surfaces of the bushings 9, 9 face each other to slidably sandwich both side faces of the blade 3 of the piston 4. The cylinder chamber 8 is divided into two chambers, i.e. suction chamber 12 and compression chamber 13, by the roller 2 and the blade 3 of the piston 4, where the right-hand chamber of the blade 3 as viewed in FIGS. 3B, 3C and 3D has a suction port 11 opened to the inner circumferential surface of the cylinder chamber 8, thereby defining the suction chamber 12. Meanwhile, the left-hand chamber of the blade 3 as viewed in FIGS. 3B, 3C and 3D has an unshown discharge port opened to the inner circumferential surface of the cylinder chamber 8, defining a compression chamber 13.

Figure 3A:
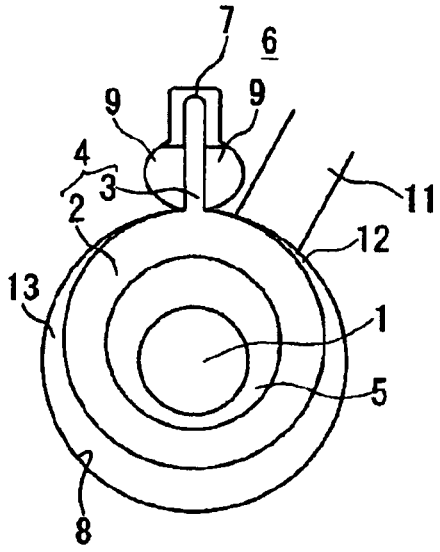
FIGS. 3A, 3B, 3C and 3D are schematic plan views showing operating states of the swing compressor.

Next, operation of the swing compressor having the above construction is explained with reference to FIGS. 3A, 3B, 3C and 3D. First, in a state shown in FIG. 3A, the eccentric portion 5 eccentrically rotates clockwise about the axial center of the drive shaft 1, so that the roller 2 fitted to the eccentric portion 5 revolves with its outer circumferential surface kept in contact with the inner circumferential surface of the cylinder chamber 8. The compressor is positioned, for example, horizontal, where the roller 2 revolves along the horizontal plane. As the roller 2 revolves within the cylinder chamber 8, the blade 3, while swinging, moves back and forth with its both side faces held by the bushings 9, 9. Then, the compressor, while sucking a low-pressure HFC base refrigerant through the suction port 11 into the suction chamber 12 (FIGS. 3B, 3C), compresses the refrigerant to high pressure in the compression chamber 13, and thereafter discharges the high-pressure HFC base refrigerant through the discharge port (not shown) (FIGS. 3C, 3D, 3A). This HFC base refrigerant having synthetic oil as lubricating oil mixed therein, when the swing compressor operates for compression, sliding surfaces inside the swing compressor, such as the inner circumferential surface of the roller 2, the outer circumferential surface of the eccentric portion 5, the outer circumferential surface of the roller 2 and the inner circumferential surface of the cylinder chamber 8, are lubricated by the lubricating oil mixed with the refrigerant.

The piston 4 of the swing compressor is formed from, for example, an iron-based sintered material. The bushings 9, 9 are formed, for example, also from an iron-based sintered material.

Figure 2A:
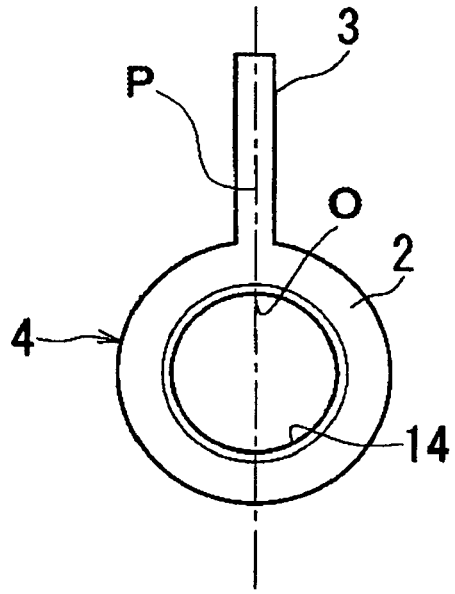
FIG. 2A is a plan view of the roller.
Figure 2B:
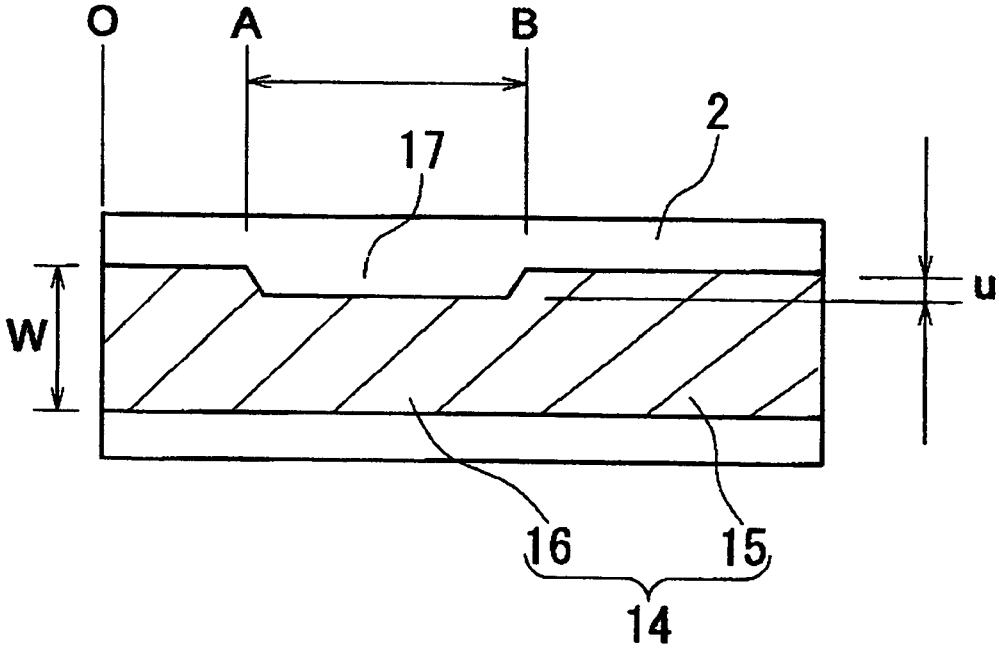
FIG. 2B is a developed view of the inner circumferential sliding surface of the roller.

Then, as shown in FIG. 1 and FIGS. 2A and 2B, an inner circumferential sliding surface 14 on which the eccentric portion 5 slides is formed on the inner circumference of the roller 2. In this inner circumferential sliding surface 14, as shown in FIG. 2B, a large-width portion 15 which is large in axial width of an axial direction of the roller 2 and a small-width portion 16 which is smaller in axial width than the large-width portion 15 are formed. The small-width portion 16 is formed in such a manner that a trapezoidal cutout portion 17 is provided at an axial upper portion of the horizontally positioned roller 2 as viewed in FIG. 2B, which is a developed view. That is, the small-width portion 16 is provided in such a manner that the upper portion of the large-width portion 15 of the sliding surface 14 having a width of W is cut out by a specified width u (about 20% of the width W). Then, the small-width portion 16 is provided over a range whose start point is a point A advanced by 30° in the clockwise rotational direction of the drive shaft 1 from a joining point O of the blade 3 in the roller 2 and whose end point is point B advanced by 150° in the rotational direction of the drive shaft 1 from the point A. The reason of this is as follows.

Figure 3B:
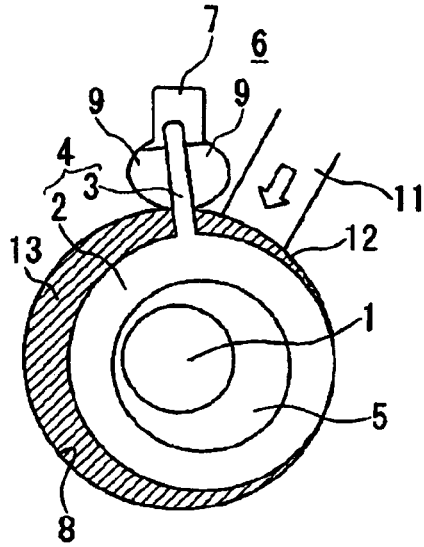
Figure 3D:
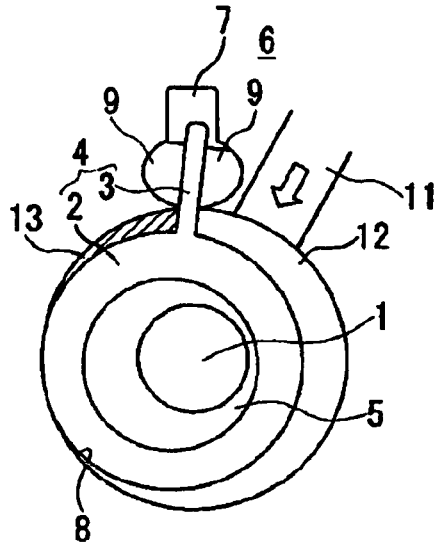
Figure 3C:
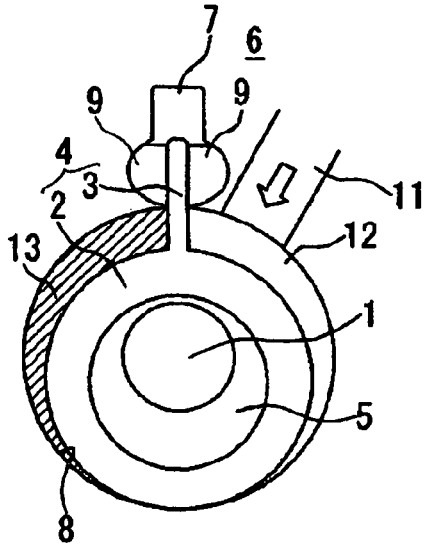

That is, in a revolving operation process ranging from the state shown in FIG. 3A to the state shown in FIG. 3C via the state shown in FIG. 3B, the sliding surface 14 of the roller 2 on the suction chamber 12 side (on the right side in the figure) serves as a light load portion, on which the load scarcely acts. Also, in a revolving operation process ranging from the state shown in FIG. 3C to the state shown in FIG. 3A via the state shown in FIG. 3D, though a load acts on the sliding surface 14 of the roller 2 on the compression chamber 13 side (on the left side in the figure), the load scarcely acts on the sliding surface 14 of the roller 2 on the suction chamber 12 side (on the right side in the figure). Accordingly, this portion of the sliding surface 14, i.e. the range whose base point is the joining point O of the blade 3 in the roller 2 and whose end point is the point B advanced by 1800 in the rotational direction of the drive shaft 1 from the base point serves as a light load portion. Therefore, the mechanical loss is reduced by forming the small-width portion 16 in this light load portion to reduce the viscous shear loss of oil at the sliding surfaces of the outer circumferential surface of the eccentric portion 5 and the inner circumferential surface of the roller 2. Then, that the start point A of the small-width portion 16 is obtained by a 30° shift from the joining point O of the blade 3, which serves as the base point of the light load portion, is purposed to ensure safety in consideration of the action of a load onto the vicinity of the joining point O of the blade 3 during the discharge operation (FIG. 3D).

According to this swing compressor, on the heavy-load side under the condition that the quantity of the load acting on the sliding surface of the roller 2 with which the eccentric portion 5 of the drive shaft 1 makes sliding contact becomes large during the rotation of the drive shaft 1, sliding area enough to endure this heavy load can be ensured by the large-width portion 15, by which enough oil film thickness between the sliding surface of the large-load-quantity eccentric portion 5 and the large-width portion 15 of the sliding surface 14 of the roller 2 can be ensured. Thus, wear and seizure due to sliding can be prevented. Still, by the formation of the small-width portion 16 in the sliding surface 14 of the smaller-load-quantity light load portion of the sliding surface 14, which is less subject to wear and seizure effects, it becomes possible to reduce the sliding area so that the viscous shear loss of oil between the sliding surface of the eccentric portion 5 and the small-width portion 16 of the sliding surface 14 of the roller 2 can be reduced. Thus, the mechanical loss in the driving of the compressor can be reduced as a whole and moreover problems due to poor lubrication can be resolved.

Moreover, since the inner circumferential sliding surface 14 can be formed only by machining of the inner circumferential surface of the generally cylindrical-shaped roller 2, the machining work can be carried out with more ease, lower price and yet higher precision, as compared with conventional machining of the eccentric portion 5. That is, since the roller 2 is cylindrical-shaped and moreover the inner circumferential sliding surface 14 and the outer circumferential surface of the roller 2 are concentric and generally cylindrical-surface shaped, the machining work of the small-width portion 16 of the sliding surface 14 of the roller 2 can be carried out with more ease, lower price and higher precision, as compared with machining work for providing the small-width portion on the outer circumferential sliding surface of the eccentric portion of the drive shaft in the prior art example. Further, the main body of the drive shaft 1 and the eccentric portion 5 are not present on one identical plane perpendicular to the center axis of the drive shaft 1, whereas the roller 2 and the blade 3 are positioned on one generally identical plane perpendicular to the center axis of the roller 2. Thus, the machining work of the small-width portion 16 of the sliding surface 14 of the roller 2 can be carried out with ease, low price and high precision.

Still, since the start point A of the small-width portion 16 is obtained by a 30° shift from the joining point O of the blade 3, which serves as the base point of the light load portion, enough durability can be ensured even if a load acts on the vicinity of the joining point O of the blade 3 during the discharge operation (FIG. 3D) Thus, the safety can be ensured.

More precisely, assuming that a reference line O is given by an intersecting line O between a plane P passing through the center of the blade 3 and parallel to the blade 3 and the inner circumferential sliding surface 14 of the roller 2, the small-width portion 16 is formed in the inner circumferential sliding surface 14 within a range extending from a line A obtained by a 30° displacement of the reference line O to a line B obtained by a 180° displacement of the reference line O in the rotational direction of the drive shaft 1 as shown in FIGS. 2A and 2B. That is, the start point A of the small-width portion 16 is obtained by a 30° shift from the joining portion O between the blade 3 and the roller 2, the joining point O serving as the start point O of the light load portion. Thus, even if a large load acts on a vicinity of the coupling portion between the blade 3 and the roller 2 during the discharge operation, the vicinity is not the small-width portion 16 but the large-width portion 15, so that enough durability as well as safety can be ensured for the swing compressor without the possibility of any damage.

In this connection, it has been found that if the small-width portion 16 is provided in the inner circumferential sliding surface 14 of the roller 2 within a region obtained by a less than 30° displacement of the reference line O in the rotational direction of the drive shaft 1, there are some cases where enough strength of the coupling portion between the blade 3 and the roller 2 cannot be ensured. It has also been found that if the small-width portion 16 is provided at a position resulting from a more than 180° displacement of the reference line O in the rotational direction of the drive shaft 1 in the inner circumferential sliding surface 14, the small-width portion 16 would be positioned on the heavy-load side, making a cause of seizure. Accordingly, in this embodiment, the small-width portion 16 is formed within the range from the line resulting from a 30° displacement to the line resulting from a 180° displacement of the reference line O in the rotational direction of the drive shaft 1 in the inner circumferential sliding surface 14 of the roller 2. As a result of this, in this embodiment, enough strength of the coupling portion between the blade 3 and the roller 2, i.e. a foot portion of the blade 3, can be ensured, and moreover the viscous shear loss of lubricating oil between the outer circumferential sliding surface of the eccentric portion 5 of the drive shaft 1 and the small-width portion 16 of the inner circumferential sliding surface 14 of the roller 2 can be reduced. Thus, the mechanical loss can be reduced and the seizure can be prevented.

In addition, the small-width portion 16 may be provided over the whole suction port 11 side of the cylinder 6 with respect to the plane P passing through the center of the blade 3 and parallel to the blade 3 (see FIGS. 2A and 2B and FIGS. 3A, 3B, 3C and 3D). Then, the small-width portion 16 is positioned on the light-load side unique to the inner circumferential sliding surface of the roller 2 of the swing compressor and never so done on the heavy-load side. Thus, the seizure of the inner circumferential sliding surface 14 of the roller 2 can be prevented.

The small-width portion 16 of the roller 2 is formed in such a manner that a cutout portion 17 is provided in the axial upper portion of the horizontally positioned roller 2. That is, with the drive shaft 1 positioned vertical, an upper edge of the small-width portion 16 is located lower than an upper edge of the large-width portion 15 so that the cutout portion 17 is located upper than the small-width portion 16 of the inner circumferential sliding surface 14 of the roller 2. Accordingly, the cutout portion 17 serves as an oil sump during the operation of the compressor, so that occurrence of lubrication insufficiency at the sliding surfaces of the outer circumferential surface of the eccentric portion 5 and the inner circumferential surface of the roller 2 can be prevented and occurrence of wear and seizure due to sliding can be prevented. Also, since the piston 4 is made of a porous sintered material, lubricating oil is held in cavities formed on the surface and inside of the piston 4, allowing enough lubrication to be ensured. Moreover, since the sintered material allows after machining to be omitted for the piston 4, the manufacturing cost for the piston 4 can be cut down. In particular, when the small-width portion 16 is formed with the provision of the cutout portion 17, the cutout portion 17 can be formed simultaneously in molding process, so that the product precision can be improved and the manufacturing cost can be cut down.

Although not shown, with the drive shaft 1 positioned inclined with respect to the horizontal plane, the upper edge of the small-width portion 16 may be located lower than the upper edge of the large-width portion 15 with respect to a direction extending along the drive shaft 1. In this case, a region extending from the upper edge of the small-width portion 16 to the upper edge of the large-width portion 15 serves as an oil sump for the lubricating oil, so that occurrence of wear and seizure of the outer circumferential sliding surface of the eccentric portion 5 and the inner circumferential sliding surface 14 of the roller 2 can be prevented.

According to this embodiment, since the piston 4 is made of a porous sintered material, lubricating oil is held in cavities formed on the surface and inside of the piston 4, allowing enough lubrication to be ensured. Moreover, if the piston 4 is molded from a sintered material, the after machining can be omitted, so that the manufacturing cost for the piston 4 can be cut down. In particular, when the small-width portion 16 is formed with the provision of the cutout portion, the cutout portion can be molded simultaneously in the molding of the piston 4, so that the product precision can be improved and the manufacturing cost can also be cut down.

It is noted that the sintered material for forming the piston 4 is not limited to iron base materials but may be aluminum, titanium or nickel base materials. The piston may be formed of ceramic.

Figure 4:
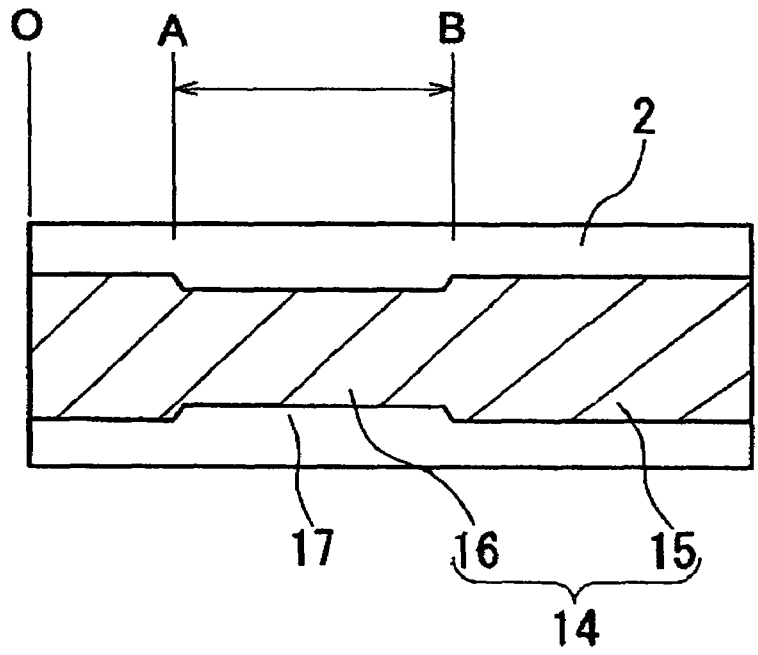
FIG. 4 is a developed view showing one modification example of the sliding surface of the roller.
Figure 5:
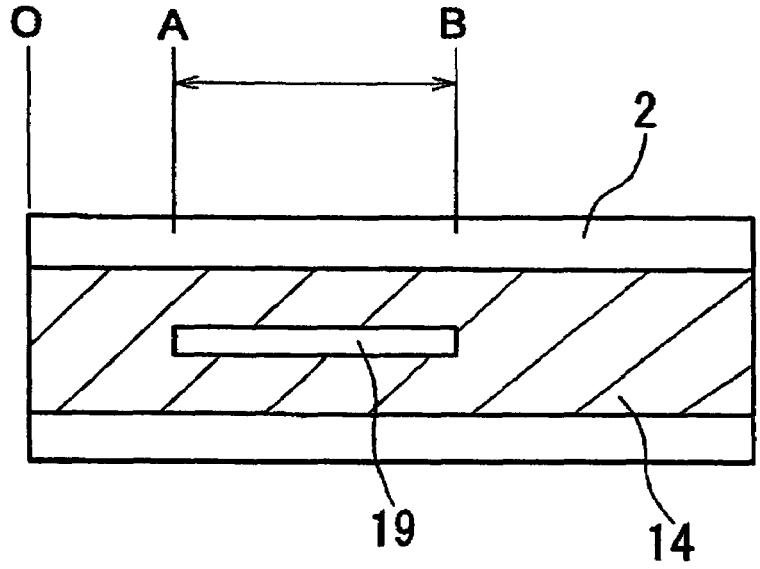
FIG. 5 is a developed view showing another modification example of the sliding surface of the roller.

Although the present invention has been described above with respect to an embodiment thereof, the invention is not limited to the embodiment but may be embodied in various changes and modifications within the scope of the invention. For instance, although the small-width portion 16 of the roller 2 is formed in such a manner that the cutout portion 17 is provided in the axial upper side portion of the ordinary sliding surface 14 of the roller 2 in the above-described embodiment, yet the small-width portion 16 of the roller 2 may be formed by providing cutout portions 17, 17 at upper and lower side portions of the ordinary sliding surface 14 of the roller 2 as shown in FIG. 4. Furthermore, the small-width portion 16 may be formed by forming a recessed portion 19 at a central portion of the ordinary sliding surface 14 of the roller 2 as shown in FIG. 5. In this case, the recessed portion 19 serves as an oil sump, so that occurrence of lubrication insufficiency at the sliding surfaces of the outer circumferential surface of the eccentric portion 5 and the inner circumferential surface of the roller 2 can be prevented and occurrence of wear and seizure due to sliding can be prevented.

What is claimed is:

1. A swing compressor comprising:

a cylinder defining a cylinder chamber;

a piston including a generally cylindrical-shaped roller which orbitally revolves along an inner surface of the cylinder chamber and a blade integrally formed with the roller that is swingably held by the cylinder, the roller having an inner circumferential sliding surface with a large-width portion configured to receive a heavy load and a small-width portion that is smaller in width than the large-width portion and is configured to receive a light load; and a drive shaft having an eccentric portion that is slidably fitted to the inner circumferential sliding surface of the roller, the piston dividing a space inside of the cylinder into a suction chamber and a compression chamber and performing a swing motion by rotation of the drive shaft, the cylinder having a reference line contained in a longitudinally extending center plane of the blade and lying on the inner circumferential sliding surface of the roller, the small-width portion being disposed only in a range extending between a point located 30° from the reference line and a point located 180° from the reference line in a rotational direction of the drive shaft in the inner circumferential sliding surface, and the small-width portion being provided on one side with respect to the longitudinally extending center plane of the blade, with the cylinder including a suction port that communicates with the suction chamber along the one side.

2. The swing compressor as claimed in claim 1, wherein the piston orbitally revolves along a horizontal plane, and an upper edge of the small-width portion is located lower than an upper edge of the large-width portion.

3. The swing compressor as claimed in claim 1, wherein the drive shaft is placed along a vertical direction of the swing compressor.

4. The swing compressor as claimed in claim 1, wherein the piston is formed of a sintered material.

* * * * *